US011140960B2

(12) United States Patent
Damptey

(10) Patent No.: US 11,140,960 B2
(45) Date of Patent: Oct. 12, 2021

(54) DESIGNER COMB

(71) Applicant: Kayvis Damptey, Redwood City, CA (US)

(72) Inventor: Kayvis Damptey, Redwood City, CA (US)

( * ) Notice: Subject to any disclaimer, the term of this patent is extended or adjusted under 35 U.S.C. 154(b) by 15 days.

(21) Appl. No.: 15/949,974

(22) Filed: Apr. 10, 2018

(65) Prior Publication Data

US 2018/0228263 A1 Aug. 16, 2018

Related U.S. Application Data

(63) Continuation of application No. PCT/US2017/043426, filed on Jul. 22, 2017, which is a continuation of application No. 15/218,008, filed on Jul. 23, 2016, now abandoned.

(51) Int. Cl.

| | |
|---|---|
| ***A45D 24/02*** | (2006.01) |
| ***A46B 9/02*** | (2006.01) |
| ***A45D 2/00*** | (2006.01) |
| ***A46B 15/00*** | (2006.01) |
| ***A45D 7/00*** | (2006.01) |
| ***A45D 24/00*** | (2006.01) |

(52) U.S. Cl.

CPC ..... *A45D 24/02* (2013.01); *A45D 2/001* (2013.01); *A45D 7/00* (2013.01); *A45D 24/00* (2013.01); *A46B 9/023* (2013.01); *A46B 15/00* (2013.01)

(58) Field of Classification Search

CPC ..... A45D 24/00; A45D 24/02; A45D 2/001; A46B 9/00; A46B 9/005

See application file for complete search history.

(56) References Cited

U.S. PATENT DOCUMENTS 1,209,516 A * 12/1916 Thompson ..... 15/188
1,780,206 A * 11/1930 McKellar ..... A45D 24/02 132/137
2,218,072 A * 10/1940 Runnels ..... A61B 17/244 606/161
2,633,591 A * 4/1953 Servilla ..... A45D 24/18 15/160
2,988,091 A 6/1961 Long
3,491,396 A * 1/1970 Granieri, Jr. ..... A46B 9/005 15/104.94

(Continued)

FOREIGN PATENT DOCUMENTS

WO 2016/001658 A1 1/2016

OTHER PUBLICATIONS

International Search Report and Written Opinion for PCT/US2017/043426, dated Oct. 2, 2017.

*Primary Examiner* — Christopher R Harmon
(74) *Attorney, Agent, or Firm* — Christopher Pilling

(57) ABSTRACT

Most methods of hair styling requires the use of gels, electric tools, or heavy and dangerous hot-irons. The invention I made alters the structure of the teeth in combs/brushes to create friction by adding edges (of various shapes and sizes) to the teeth to rob against the hair as the hair is being combed/brushed thus causing friction and creating heat. The heat created and the force of the friction of the Designer Comb straightens the hair for all hair types but for 3 b hair and kinkier it also flattens the hair so people with afros can simply comb up the sides of their hair to get a high-top hair style.

7 Claims, 1 Drawing Sheet

(56) References Cited

U.S. PATENT DOCUMENTS

| | | | | | |
|---|---|---|---|---|---|
| 3,491,777 | A * | 1/1970 | Gregory | A46B 11/0017 | 132/120 |
| 3,628,545 | A | 12/1971 | Moody | | |
| 4,502,498 | A * | 3/1985 | Saferstein | A45D 24/04 | 132/137 |
| 4,763,675 | A * | 8/1988 | DeFelice | A45D 24/02 | 132/137 |
| 5,231,999 | A * | 8/1993 | Schroettner | A45D 24/34 | 132/137 |
| 5,273,058 | A | 12/1993 | Edwards | | |
| 5,626,099 | A * | 5/1997 | Staller | A01K 13/00 | 119/600 |
| 5,657,775 | A * | 8/1997 | Chou | A46B 7/04 | 132/125 |
| 5,713,379 | A | 2/1998 | Collins et al. | | |
| 6,189,540 | B1 | 2/2001 | Stovall et al. | | |
| 6,412,496 | B1 * | 7/2002 | Gueret | A45D 40/267 | 132/218 |
| 6,539,950 | B1 * | 4/2003 | Gueret | A45D 40/267 | 132/218 |
| 8,529,149 | B2 * | 9/2013 | Yun | A46B 5/0095 | 401/196 |
| 2005/0015901 | A1 * | 1/2005 | Gavney, Jr. | A47L 1/06 | 15/28 |
| 2009/0101160 | A1 * | 4/2009 | Ruckart | A45D 24/04 | 132/136 |
| 2011/0083292 | A1 * | 4/2011 | Boyd | A45D 2/38 | 15/160 |
| 2012/0110767 | A1 * | 5/2012 | Newnham | A46B 9/005 | 15/167.1 |

* cited by examiner

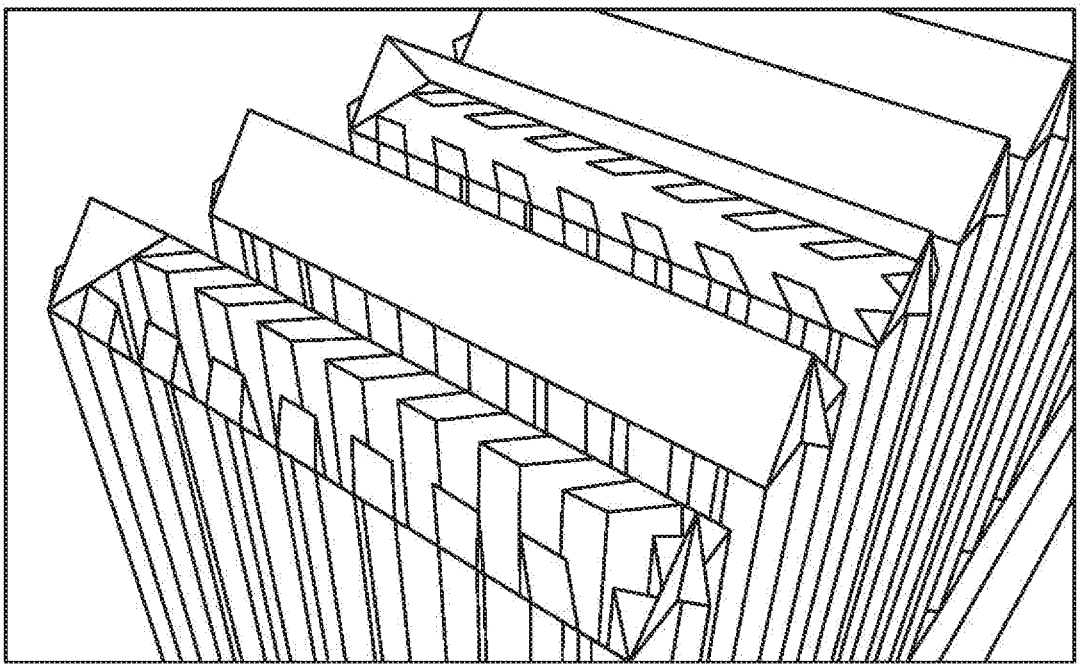

DESIGNER COMB

This application is a Continuation of International Patent Application No. PCT/US2017/043426, filed Jul. 22, 2017, which claims benefit of U.S. patent application Ser. No. 15/218,008, filed Jul. 22, 2016 and which applications are incorporated herein by reference. To the extent appropriate, a claim of priority is made to each of the above disclosed applications.

BACKGROUND OF THE INVENTION

Most methods of hair styling requires the use of gels, electric tools, or heavy and dangerous hot-irons. This invention adds a mechanism to create friction and thus heat by adding edges (of various shapes and sizes) to the teeth of combs and brushes to rub against the hair as the hair is being combed/brushed thus causing friction and creating heat.

BRIEF SUMMARY OF THE INVENTION

The designer comb (here comb in the context of "designer combs" is a reference to the invention and all it's forms, while otherwise comb will refer to the classical definition of a. comb and not that of a brush although a "designer comb" can have the form of a brush), is a tool that has added edges to the teeth of a comb or brush so that when the user pushes/pulls the tool through their hair friction is created, the friction and thus heat are both an effect of the invention's incorporation of rough (relative to the material used to make the tool) edges. The heat created and the force of the friction of the Designer Comb straightens the hair for all hair types but for 3b hair and kinkier it also flattens the hair so people with afros can simply comb up the sides of their hair to get a high-top hair style. Since the designer comb doesn't require electricity or preheating by fire, oven, etc., the user can get their high-tops in between classes, work and socialising, anywhere the air is not extremely cold or humid (exact climate metrics depends on the comb type specified by the customer and their hair type).

Only other tools capable of these effects are consumables like gel and electric flat irons, or are heavy and dangerous such as a hot comb. All of which cost more to make than the designer comb.

A BRIEF DESCRIPTION OF THE DRAWINGS

FIG. 1 This drawing shows a close up on the teeth of the saw-like designer comb with two teeth having part of their caps removed to show the inner structure of the teeth and their edges.

DETAILED DESCRIPTION OF THE MANNER AND PROCESS OF MAKING AND USING THE INVENTION

The invention can take many forms but one form that will be illustrated today is a comb with a saw-like teeth and a brush with teeth having shafts in the shape of stars will be used as an example of a possible alternative shape of the designer comb. Both can be used like a normal brush Or comb (its suggested to use the invention after the doing basic detangling as the edges may break knotted hair and for people with thin hair or hair that can easily fall out to not use the invention as the pulling on the hair may worsen their condition). With hair that is not wetter than damp simply brush or comb your hair in the desired direction a few times (3-5 times) and the heat will straighten and flatten that section of hair. This heat is generated by the edges of the saw-like comb that is displayed in FIGURE I. The side of the top of the comb's tooth was removed to better contrast the edges on the side to how they are formed in the inside of the saw-like tooth.

The customer can then request to increase or decrease the number of edges, or even have a more wavy shape for certain hair styles (like the saw-comb mentioned earlier rising in a wavy fashion from the base of the tool).

These combs can typically be made via: 3D printing the drawn model, lost-wax (the process used to make jewelry and toys), and potentially extruded and threaded for some forms like the star-like brush.

What is claimed is:

1. A comb comprising a plurality of elongated teeth extending generally in parallel to each lather, the plurality of elongated teeth being separated from each other, wherein each of the plurality of elongated teeth comprises on at least one side of the tooth a plurality of edges between outermost edges; and, wherein for each of the plurality of elongated teeth, the plurality of edges on the tooth between the outermost edges on at least one side of the tooth form at least one channel on the tooth extending along the length of the tooth.

2. The comb of claim 1, wherein each of the plurality of teeth comprises a cross sectional geometry defined by the plurality of edges.

3. The comb of claim 1, wherein for each of the plurality of elongated teeth, the plurality of edges on the tooth between the outermost edges on at least one side of the tooth form a plurality of channels on the tooth extending along the length of the tooth.

4. The comb of claim 1, wherein the edges are rough edges.

5. The comb of claim 1, wherein each of the plurality of teeth comprises at least three edges on the tooth between the outermost edges on at least one side of the tooth.

6. The comb of claim 2, wherein the cross-sectional geometry defined by the plurality of edges is saw-like.

7. The comb of claim 2, wherein the cross-sectional geometry defined by the plurality of edges is a star.

* * * * *